US006989041B2

(12) United States Patent
Ito et al.

(10) Patent No.: US 6,989,041 B2
(45) Date of Patent: Jan. 24, 2006

(54) PROCESS FOR PRODUCING TITANIUM SPONGE

(75) Inventors: Nobuaki Ito, Chiba (JP); Masanori Yamaguchi, Kanagawa (JP); Kenichi Kato, Kanagawa (JP); Shigeo Ampo, Kanagawa (JP)

(73) Assignee: Toho Titanium Co., Ltd., Chigasaki (JP)

( * ) Notice: Subject to any disclaimer, the term of this patent is extended or adjusted under 35 U.S.C. 154(b) by 234 days.

(21) Appl. No.: 10/405,641

(22) Filed: Apr. 3, 2003

(65) Prior Publication Data

US 2003/0196514 A1 Oct. 23, 2003

(30) Foreign Application Priority Data

Apr. 19, 2002 (JP) ..... 2002-117282

(51) Int. Cl.
*C22B 34/12* (2006.01)

(52) U.S. Cl. ..... 75/369; 75/620

(58) Field of Classification Search ..... 75/369, 75/619, 620

See application file for complete search history.

(56) References Cited

U.S. PATENT DOCUMENTS 3,847,596 A * 11/1974 Holland et al. ..... 75/619
4,518,426 A * 5/1985 Murphy ..... 75/619

FOREIGN PATENT DOCUMENTS

JP 08-295955 11/1996

* cited by examiner

*Primary Examiner*—George Wyszomierski
(74) *Attorney, Agent, or Firm*—Oblon, Spivak, McClelland, Maier & Neustadt, P.C.

(57) ABSTRACT

A process for producing titanium sponge includes carrying out a reduction reaction by supplying titanium tetrachloride to a reaction vessel which stores a reduction bath liquid containing an upper layer of a reactant bath liquid layer containing fused magnesium as a main component and a lower layer of a product bath liquid layer containing fused magnesium chloride as a main component, wherein the level of the interface between the reactant bath liquid layer and the product bath liquid layer and the level of the reduction bath liquid surface are controlled in response to an accumulated supply of titanium tetrachloride.

8 Claims, 6 Drawing Sheets

PROCESS FOR PRODUCING TITANIUM SPONGE

FIELD OF THE INVENTION

The present invention relates to a process for producing titanium sponge capable of achieving an efficient reaction, particularly in the reduction step of reducing titanium tetrachloride with fused magnesium, in the Kroll process wherein metallic titanium is produced by chlorinating titanium ore to form titanium tetrachloride and reducing it.

BACKGROUND ART

With regard to the reduction step of obtaining metallic titanium from titanium tetrachloride as an intermediate product among the steps for producing metallic titanium from titanium ore, so-called the Kroll process is most commonly adopted industrially. The following will describe the reducing process of titanium in the Kroll process with reference to FIG. 4A. First, titanium ore is chlorinated to form titanium tetrachloride which is liquid at ordinary temperature. Then, through a liquid titanium tetrachloride supply pipe 8, titanium tetrachloride is supplied to a tightly closed reduction reaction vessel 1, i.e., onto a reactant bath liquid 2 in a reaction vessel 1. Highly pure metallic titanium is obtained by changing magnesium into fused magnesium dichloride and titanium tetrachloride into metallic magnesium in the reaction vessel through the following chemical reaction.

$$TiCl_4+Mg \rightarrow Ti+MgCl_2 \quad (1)$$

Metallic titanium precipitates as fine particles in the reaction vessel and then the particles are sintered each other to form a porous titanium sponge mass. Moreover, since specific gravity of fused magnesium dichloride as a by-product is larger than that of fused magnesium and also fused magnesium dichloride and fused magnesium hardly dissolve in each other, magnesium dichloride precipitates on the bottom of the vessel to form a product bath liquid layer 3 and forms a definite reactant-product bath liquid interface 4 between the layer 3 and a reactant bath liquid layer 2. After precipitation, magnesium dichloride formed in the reactant bath liquid is absorbed in the product bath liquid 3. The volume of the reduction bath liquid gradually increases as a result of the formation of the product during the reduction reaction but the product bath liquid is adequately discharged to the outside of the vessel through a product bath liquid-discharge pipe 9 by forcing a bath surface 5 caused by periodical introduction of high-pressure argon into a space above the bath surface 5 through an argon gas supply pipe 10. As a result, the level 19 of the bath surface is maintained within a certain range. After the accumulated supply of titanium tetrachloride has reached a predetermined level, the reduction bath liquid is discharged to the outside of the vessel and the titanium sponge is taken out of the vessel as a product after separating the reduction bath liquid remained in the voids by heating in vacuo. In the case of a recent representative large-scale reduction reaction apparatus, the size of the reaction vessel is up to a diameter of about 2 m, a height of about 5 m, and a depth of the reduction bath liquid of 4 m, and a little less than 10 tons of titanium sponge is produced at one batch production.

The "reactant bath liquid" 2 herein means a liquid layer in the reaction vessel containing fused magnesium as a main component and titanium tetrachloride, and is present at an upper part in the bath liquid owing to its small average density. Moreover, the "product bath liquid" 3 means a liquid layer in the reaction vessel containing fused magnesium chloride as a main component and formed titanium fine particles, and is present at a lower part in the bath liquid owing to its large average density. Furthermore, the "reduction bath liquid" includes both of the reactant bath liquid and the product bath liquid. The "reactant-product bath liquid interface" means an interface between the reactant bath liquid layer and the product bath liquid layer.

The titanium sponge mass formed in the reduction step is classified into a titanium sponge large mass part 6 and a sponge upper wall part 7 and both of them grow individually. The titanium sponge large mass 6 is a large mass which grows upward from the bottom of the reaction vessel and accounts for most part of total weight of the sponge mass. Moreover, the sponge upper wall part 7 is a sponge mass which grows from the inner wall of the reaction vessel near the bath surface toward the inside of the radical direction of the reaction vessel.

In general, the larger the weight of titanium sponge producible in one batch is, the higher the productivity is and the lower the production cost is. The weight of titanium sponge producible in one batch is determined by the quantity of titanium tetrachloride supplied until the titanium sponge large mass grows and the top of the large mass reaches the bath surface of the reduction bath liquid. This is because the direct contact of titanium tetrachloride liquid supplied with the titanium sponge mass results in an unstable reduction reaction and causes problems of the clogging of the titanium tetrachloride-supply pipe and contamination of product titanium and hence reduction should be finished at the point of time when the top of the large mass reaches the bath surface of the reduction bath liquid in order to avoid the problems. In the conventional art, the titanium sponge large mass had a conical shape as shown in FIG. 4B. Therefore, there existed a large space filled with the reduction bath liquid between the titanium sponge large mass and the inner wall of the cylindrical vessel at the point of time when reduction was finished, and thus there was a problem that the production of titanium sponge per one batch decreased.

Some attempts have been hitherto made for solving the problem. For example, JP-A-8-295955 aims at increase of the average diameter of the sponge large mass to allow it to grow in a pillar form by supplying titanium tetrachloride over a wide range of the reduction bath liquid dispersively. (The term "JP-A" as used herein means an "unexamined published Japanese patent application".) However, although JP-A-8-295955 is silent about a size of the reaction vessel, as a result of precise investigations by the present inventors, it has been found that the region of the sponge mass whose average diameter is increased by this method is limited to the depth range shallower than 500 mm below the bath surface of the reduction bath liquid and thus it is only effective in a very small part of the sponge large mass having a height of more than 3 m in the current representative reduction reaction apparatus. Furthermore, a diameter-increasing effect on the titanium sponge large mass by this method within the depth range shallower than 500 mm below the bath surface of the reduction bath liquid is only a little and the shape of the whole titanium sponge large mass is still regarded as a conical shape. This is because a large circulating flow exists in the reduction bath liquid. That is, even when the titanium tetrachloride-supplying spots are diverged to expand the metallic titanium particle-generating spots on the bath surface, produced titanium particles are stirred by the circulating flow in the most part of the bath liquid, so that the difference in the effect from the case that titanium tetrachloride is supplied only to the central part of the bath surface becomes small.

The reason why the conical shape titanium sponge large mass is formed irrespective of the titanium tetrachloride-supplied position in the case that the circulating flow exists in the reduction bath liquid has been hitherto unknown. As a result of precise investigations by the inventors, however, it has been found for the first time that this phenomenon is due to a positional change of the reactant-product bath liquid interface. The following will describe the specific mechanism.

Although a level 20 of the reactant-product bath liquid interface may fluctuate during the reducing reaction, the level of the reactant-product bath liquid interface tends to increase as the passage of the reaction time when the overall reduction reaction is considered from a broader perspective. An average increase of the level of the reactant-product bath liquid interface per unit weight of titanium tetrachloride supply is defined as an "elevating rate of the reactant-product bath liquid interface" θ. As a result of the precise investigations, the inventors have found that a relationship shown in FIG. 5 is present between the elevating rate of the reactant-product bath liquid interface θ and the diameter of the titanium sponge large mass. The "average diameter of the titanium sponge large mass" means an average sponge diameter in the vertical direction of the large mass when the titanium sponge large mass is regarded as a cone or a cylinder or a shape composed of a cylinder overlaid with a cone. In FIG. 5, the tendency of the relationship between θ and the average diameter of the titanium sponge large mass changes at a point (a) as a border. That is, when θ is larger than the point (a), the average diameter of the titanium sponge large mass increases as θ decreases. This is because a height 21 of the titanium sponge large mass is regulated by the level 20 of the reactant-product bath liquid interface and cannot exceed the level 20 of the interface to a large extent. As a result, when θ is large, the titanium sponge large mass can grow upward and hence the average diameter of the titanium sponge large mass decreases. To the contrary, when θ is small, the upward growth of the titanium sponge large mass is suppresed and the mass mainly grows in the radial direction, so that the average diameter of the titanium sponge large mass increases. On the other hand, when θ is smaller than the point (a), the average diameter of the titanium sponge large mass has a constant value irrespective of θ. This is because the titanium sponge large mass can no longer grow in the radial direction in this region since the sponge has grown in the radial direction to come into contact with the inner wall of the reaction vessel. In the conventional art, the operation point of θ is determined so as to maintain a level 19 of the bath surface constant during the reduction reaction. When each physical value is substituted for the chemical equation of the formula (1), the volume of the reduction bath liquid increases by about 0.5 $m^3$ by the formation of a product in the case that 1 t of titanium tetrachloride is supplied into the reaction vessel. In the conventional art, in order to maintain the level of the bath surface constant, i.e., to maintain the volume of the reduction bath liquid constant, the volume of the reduction bath liquid increased by the reaction should be discharged to the outside of the reaction vessel. Because the reduction bath liquid to be discharged is a product bath liquid containing magnesium dichloride as a main component, it is enough to discharge about 0.82 t of the product bath liquid per 1 t of the titanium tetrachloride supply, i.e., to set a discharge rate of the product bath liquid at 0.82 t (product)/t (titanium tetrachloride) based on the calculation using the physical values of magnesium dichloride. Since the discharge rate of the product bath liquid corresponds to θ in one-to-one manner, θ in the conventional art becomes a fixed condition and it is found that the conventional operation condition exists in a region where θ is larger than the point (a) as shown in FIG. 5. Therefore, in the conventional art, the average diameter of the titanium sponge large mass is smaller than the average inner diameter of the reaction vessel to a large extent and hence a titanium sponge large mass having a large weight through full utilization of the space in the reduction bath liquid cannot be formed.

The following will describe the reason why the level 20 of the reactant-product bath liquid interface determines the height 21 of the titanium sponge large mass. This phenomenon has also been found for the first time based on the results of precise investigations by the inventors. First, precipitation behavior of formed metallic titanium particles 18 in the reduction bath liquid will be explained with reference to FIG. 9. Titanium tetrachloride is supplied from above the bath surface and hence metallic titanium particles are formed near the bath surface (point (a)). Since the density of the metallic titanium particles is larger than the average density of the reduction bath liquid, the metallic titanium particles precipitates and settles on the titanium sponge large mass to allow to grow the titanium sponge large mass. Three kinds of the precipitation and settling routes of the metallic titanium are present when roughly classified. The first route is a route (b) wherein the metallic titanium particles pass through the reactant-product bath liquid interface and attach to the sponge mass in the product bath liquid. The second route is a route (c) wherein the metallic titanium particles are transported by the circulating flow present in the reactant bath liquid to descend along the inner wall of the reaction vessel and without passing through the reactant-product bath liquid interface, transferred in the central direction of the vessel to attach to the skirt of the sponge mass exposed above the interface. The third route is a route (d) wherein the metallic titanium particles descend and directly attach to the titanium sponge large mass exposed to the reactant bath liquid without coming into contact with the reactant-product bath liquid interface. Of these three routes, the route (c) is always a main route. The reasons are as follows. First, the reason why the route (b) hardly occurs is that the size of the metallic titanium particles is usually extremely small, e.g., about several tens μm or less, and hence the particles cannot easily pass through the reactant-product bath liquid interface. This is because, when the particles break through the interface, gravitational force should overcome a resisting force against particle precipitation owing to the curved interface, i.e., a resisting force according to the Laplace equation, and a resisting force against particle precipitation derived from interfacial tension imparted at the time when metallic titanium particles existing in the wetting reactant bath liquid intrude into the less wetting product bath liquid layer. The Laplace equation is expressed by the following equation. At the precipitation of the particles, a static pressure between the particles and the reactant-product bath liquid interface is elevated by deforming the reactant-product bath liquid interface into a downward convex shape, and thereby the particle precipitation is resisted.

$$[\text{Static pressure near two liquid interface}] = 2 \times [\text{Interfacial tension between two liquid}] / [\text{Curvature radius of interface between two liquid}] \quad (2)$$

In the case of fine particles having a larger surface area relative to the volume, gravitational force seldom exceeds such a resisting force imparted to the surface. As a result of the investigations by the inventors, it has been found that the particle size of metallic titanium should be at least about several mm for realizing the passage through reactant-product bath liquid interface. Since such large particles exist in only a small amount in the bath, a small ratio of metallic titanium particles passes through the route (b). The following will explain the reason why the route (d) hardly occurs. The ratio of metallic titanium particles passing along the route (d) increases as the height of the titanium sponge large mass increases and the metallic titanium-forming position comes near the top of the large mass. However, in the case that the top of the large mass is, e.g., 500 mm or more apart from the bath surface, most of the formed metallic titanium particles are once transported to the outside of the radial direction by the circulating flow existing under the bath surface, and then transferred to the reactant-product bath liquid interface by the circulating flow along the inner wall of the reaction vessel, so that the ratio of the particles passing along the route (d) is small. Therefore, the route (c) is a main route for precipitation of metallic titanium particles. In the route (c) as a main route, since titanium sponge mass grows by attaching most of the formed metallic titanium to the titanium sponge large mass in the reactant bath liquid just above the reactant-product bath liquid interface, it is not probable that the titanium sponge large mass rapidly grow during the reduction reaction in the height region where the reactant-product bath liquid interface does not yet reach. In this sense, it can be said that the level of the reactant-product bath liquid interface determines the height of the titanium sponge large mass.

The following will describe the reason why the titanium sponge large mass forms a conical shape in the conventional art. In the conventional art, since the elevation rate of the reactant-product bath liquid interface is large, the titanium sponge large mass does not grow largely in the radial direction except the bottom part of the titanium sponge large mass and grows upward in a long and narrow form. At that time, since the titanium sponge is formed at an early stage of the reduction reaction at the lower part of the large mass, the titanium sponge grows over a longer period of time. The route (b) in FIG. 9 is not a main route for precipitation and attachment but there exists in a certain ratio, so that metallic titanium particles attaches to the side surface of the titanium sponge mass at the lower part where the titanium sponge grows over a long period of time and hence the diameter of the titanium sponge mass increases at the lower part. On the other hand, such a diameter-increasing mechanism of the titanium sponge mass is difficult to work because only a short period of time has passed from the beginning of the formation of the sponge at the upper part of the titanium sponge mass and the rate of the attachment of titanium particles by the route (d) shown in FIG. 9 is larger at the higher position of the titanium sponge large mass, so that the titanium sponge large mass shows a tendency of growing selectively upward. As a result, the sponge mass grows conically in the order of (a)→(b)→(c) shown in FIG. 10.

SUMMARY OF THE INVENTION

As a result of the extensive studies based on the analysis results on the sponge-forming behavior in actual operation mentioned above, the present inventors have solved the problems which have remained in the conventional art and thus accomplished the invention.

Namely, the process for producing titanium sponge of the invention comprises, as the first invention, carrying out a reduction reaction by supplying titanium tetrachloride to a reaction vessel which stores a reduction bath liquid comprising an upper layer of a reactant bath liquid layer containing fused magnesium as a main component and a lower layer of a product bath liquid layer containing fused magnesium chloride as a main component, wherein the level of the interface between the reactant bath liquid layer and the product bath liquid layer and the level of the reduction bath liquid surface are controlled in response to an accumulated supply of titanium tetrachloride.

As the second invention, the level of the interface between the reactant bath liquid layer and the product bath liquid layer and the level of the reduction bath liquid surface are changed by immersing a block-like article which is placed at an upper part in the reaction vessel and is capable of moving upward and downward, in the process of the first invention.

As the third invention, the level of the reduction bath liquid surface is controlled by supplying solid or liquid magnesium from the outside of the reaction vessel during the reduction reaction, in the process of the first invention.

As the fourth invention, the level of the interface between the reactant bath liquid layer and the product bath liquid layer is calculated from shape of formed titanium sponge mass, quantities of fused magnesium and fused magnesium chloride contained in the titanium sponge mass, a quantity of initial reduction bath liquid, an accumulated supply of titanium tetrachloride, and an accumulated discharge of the product, in the process of the first or second invention.

By applying the invention, the titanium sponge mass is formed in a cylindrical form and the space in the reduction bath liquid is effectively utilized. As a result, the maximum production of the titanium sponge per one batch can be increased as compared with the conventional art. Thus, the productivity can be improved and also the production cost can be reduced.

Figure 1A:
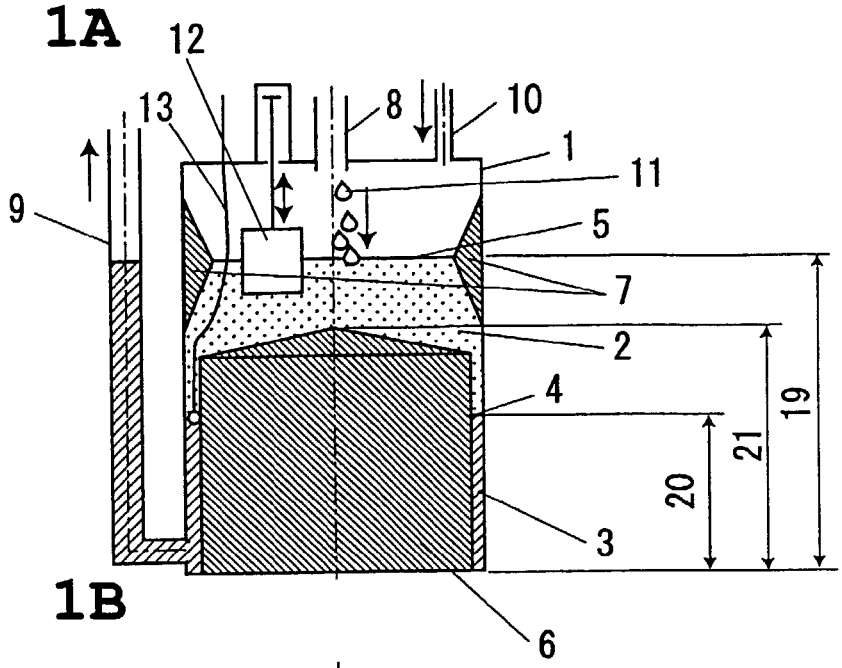
FIGS. 1A and 1B each is a conceptual illustration of the first and second inventions.

The following are descriptions of reference numericals.

1. Reaction vessel wall
2. Reactant bath liquid
3. Product bath liquid
4. Reactant-product bath liquid interface
5. Reduction bath liquid surface
6. Titanium sponge large mass
7. Titanium sponge upper wall
8. Titanium tetrachloride liquid-supply pipe
9. Product bath liquid-discharge pipe
10. Argon gas-supply pipe
11. Titanium tetrachloride supply liquid
12. Bath surface level-changing apparatus
13. Reactant-product bath liquid interface level meter
14. Magnesium-supply pipe
15. Shift in reactant-product bath liquid interface level
16. Shift in height of titanium sponge large mass
17. Shift in level of reduction bath liquid surface
18. Metallic titanium particle
19. Level of reduction bath liquid surface
20. Level of interface between reactant bath liquid layer and product bath liquid layer
21. Height of titanium sponge large mass

DETAILED DESCRIPTION OF THE INVENTION

First, essential points of the difference between the first invention and the conventional art are described. In the conventional art, the supply of titanium tetrachloride and the discharge of the product liquid is set during the reduction reaction so that only the level 19 of the reduction bath liquid surface is maintained in a certain range. Therefore, the level 20 of the reactant-product bath liquid interface necessarily changes at a large rate of elevation and hence the titanium sponge large mass 6 is formed conically. On the other hand, in the first invention of the present application, the level 19 of the reduction bath liquid surface and the level 20 of the reactant-product bath liquid interface during the reduction reaction are independently set so as to achieve individual aimed fluctuation shifts. As a result, by setting the level of the reactant-product bath liquid interface at a small rate of interface elevation, the titanium sponge large mass can be formed cylindrically and the production per one batch in the reaction vessel having the same volume can be increased. Moreover, as mentioned above, the phenomenon that the shift of the level of the reactant-product bath liquid interface during the reduction reaction controls the shape of the titanium sponge large mass has been itself hitherto unknown and has been found by the inventors for the first time.

Figure 5:
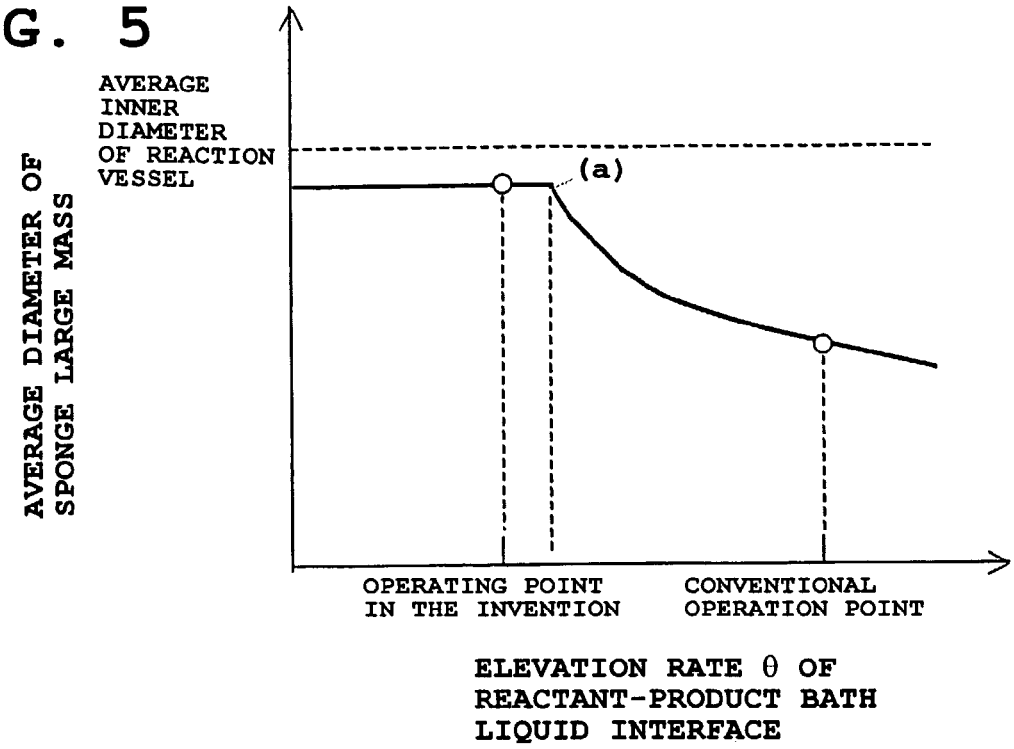
FIG. 5 is a conceptual illustration of relationship between the growth rate of the height of the titanium sponge large mass and the average diameter of the titanium sponge large mass.
Figure 6:
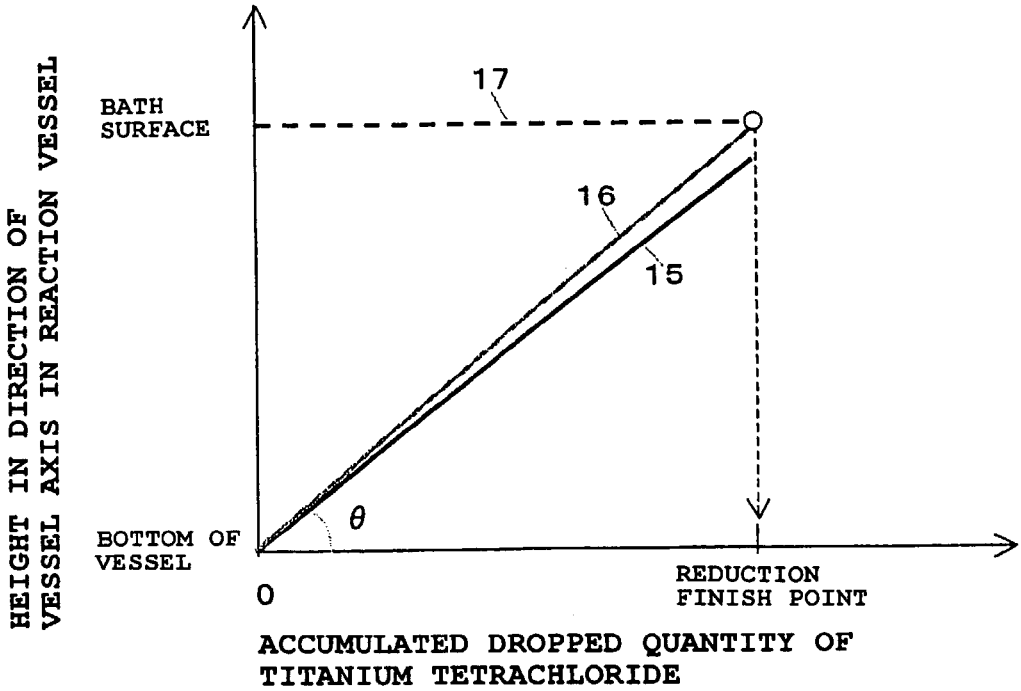
FIG. 6 is a conceptual illustration of fluctuation of the reactant-product bath liquid interface during the reduction reaction in the conventional art.
Figure 7:
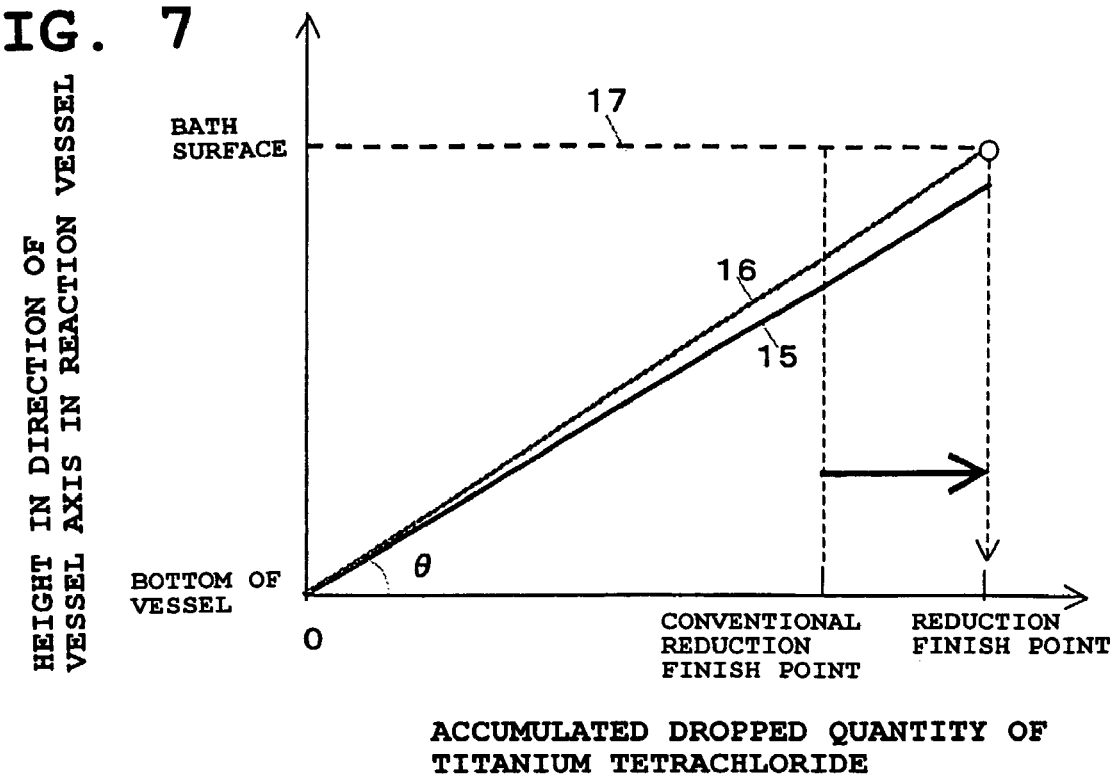
FIG. 7 is a conceptual illustration of fluctuation of the reactant-product bath liquid interface during the reduction reaction in the first invention.
Figure 8:
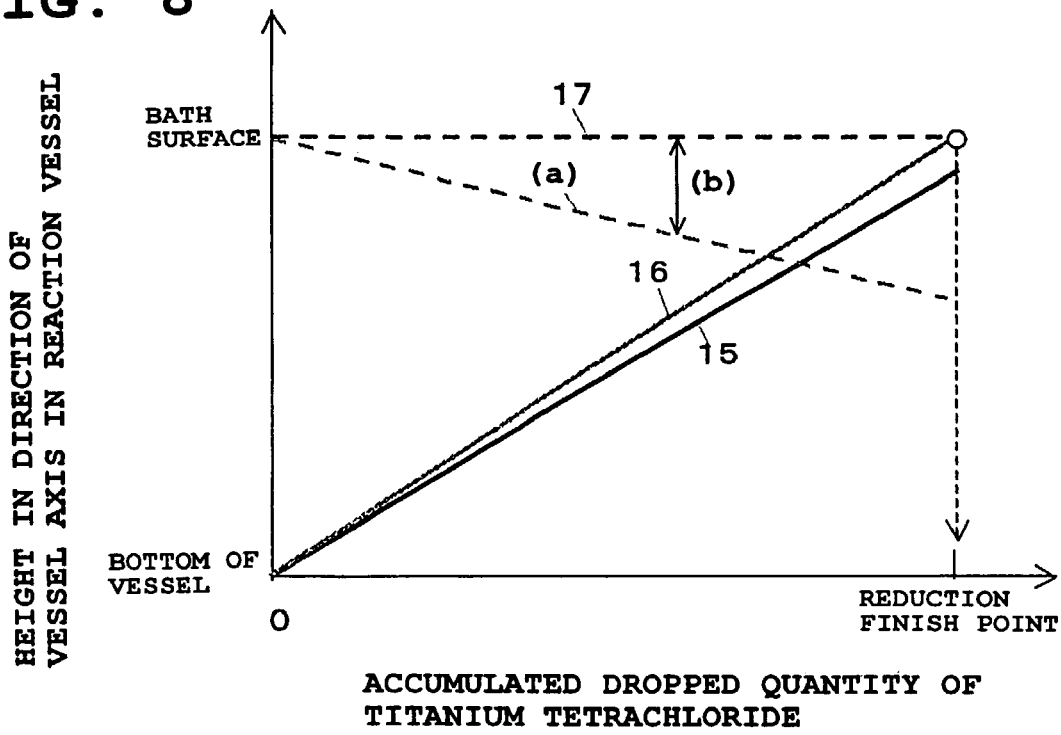
FIG. 8 is a conceptual illustration of fluctuation of the reactant-product bath liquid interface during the reduction reaction in the first invention.
Figure 9:
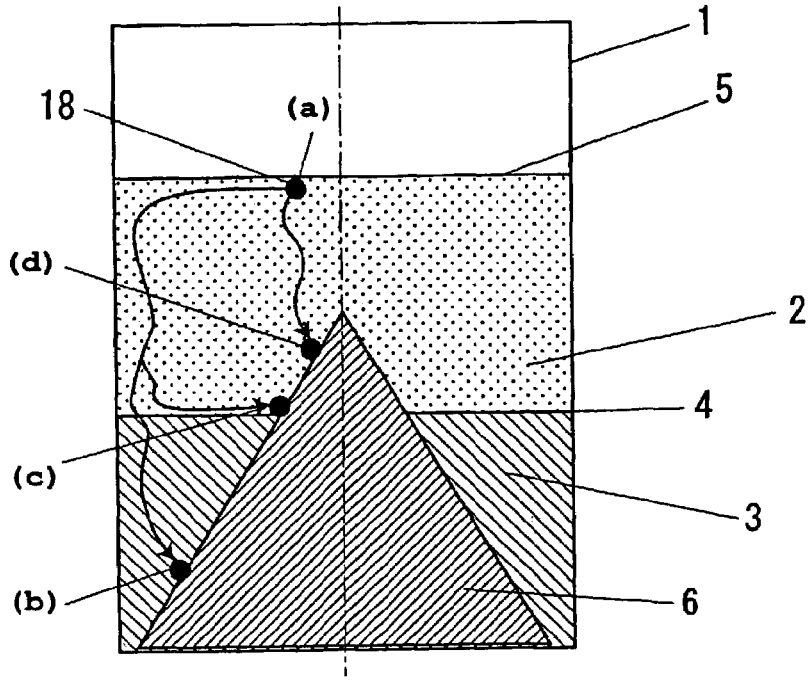
FIG. 9 is a conceptual illustration of precipitation tracks of the titanium particles in the reduction bath liquid.
Figure 10:
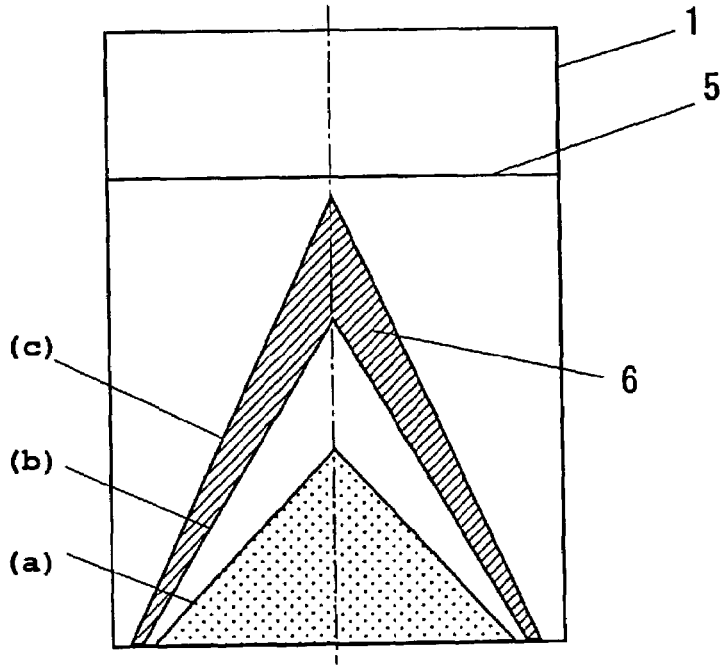
FIG. 10 is a conceptual illustration of growth of the titanium sponge large mass in the conventional art.

The following will explain fluctuation images of the level 19 of the reduction bath liquid surface and the level 20 of the reactant-product bath liquid interface during the reduction reaction in the first invention with reference to FIG. 7. In the first invention, the level 20 of the reactant-product bath liquid interface is detected or estimated and is set at an aimed fluctuation shift of the level which is independent to the bath surface of the reduction bath liquid. At that time, in the example of FIG. 7, with regard to the level shift 15 of the reactant-product bath liquid interface, the elevation rate of the interface is set at a value lower than that in the conventional art. As shown in FIG. 5, in the case that the elevation rate of the reactant-product bath liquid interface is small, the average diameter of the titanium sponge large mass increases, so that a larger quantity of the sponge can be formed in the reduction bath liquid as compared with the conventional art even when the height of the titanium sponge large mass is the same. That is, the accumulated supply of titanium tetrachloride can be increased at the end of the reduction reaction which is determined by the point of time when the height shift 16 of the titanium sponge large mass becomes the same as the bath surface level shift 17, as compared with the case in the conventional reduction reaction. The decrease of the elevation rate of the level 20 of the reactant-product bath liquid interface means an increased discharge of the product bath liquid from the reaction vessel during the reduction reaction. Therefore, a simple application of such a level shift 15 of the reactant-product bath liquid interface in the conventional art may result in the level shift of the reduction bath liquid surface shown by Line (a) in FIG. 8. In this case, the level of the reduction bath liquid surface gradually lowers and the top of the large mass is exposed above the bath surface of the reduction bath liquid during the reduction reaction. Thus, there arises a problem that the reduction reaction cannot be continued after this point. Therefore, in the first invention, with regard to the level 19 of the reduction bath liquid surface, by changing the level of the reduction bath liquid surface, the level of the reduction bath liquid surface is set so as to compensate the difference corresponding to the portion (b) in FIG. 8, and thereby the bath surface shift 17 in FIG. 8 can be achieved wherein the titanium sponge large mass is not easily exposed above the bath surface of the reduction bath liquid. In this regard, in FIG. 7, the level shift line 15 of the reactant-product bath liquid interface has been expressed by a flatly increasing straight line, which corresponds to the case that the level of the reactant-product bath liquid interface is continuously changed and regulated always during the reduction reaction. Moreover, when an apparatus for changing the level of the reactant-product bath liquid interface is worked intermittently, an ever-increasing saw-toothed surface shift is observed wherein an elevation of the level of the reactant-product bath liquid interface and a decrease of the level of the interface are repeated alternately. In the case that the operation quantity of the apparatus for changing the level of the reactant-product bath liquid interface per one time is small, e.g., 500 mm or less in terms of the fluctuation of the level of the interface, about the same effect is obtained as in the case that the apparatus for changing the level of the reactant-product bath liquid interface is operated continuously, even when the apparatus is operated intermittently.

Figure 1B:
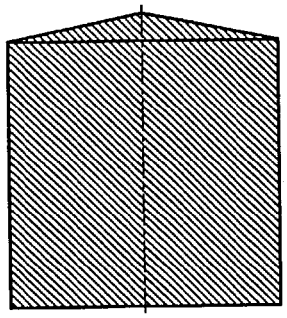

The following will explain the process of the first invention with reference to FIGS. 1A and 1B. It is the same as the conventional reduction reaction that titanium tetrachloride liquid 11 is supplied and the reactant bath liquid layer 2 and the product bath liquid layer 3 are formed in the reaction vessel 1. In the first invention, a characteristic feature is that the level 20 of the reactant-product bath liquid interface is determined using a reactant-product bath liquid interface level meter 13 or by estimation from a prediction model and then the level is changed as the occasion demands using a means for changing the level of the reactant-product bath liquid interface so as to satisfy the aimed range of the level of the reactant-product bath liquid interface predetermined relative to an accumulated supply of titanium tetrachloride during the reduction reaction. As an example of the method for changing the level of the reactant-product bath liquid interface, in FIG. 1A, as in the conventional art, the discharge of the product bath liquid from the product bath liquid-discharge pipe 9 is regulated by introducing high-pressure argon gas from an argon gas-supply pipe 13 into the reaction vessel so as to satisfy a predetermined level of the reactant-product bath liquid interface.

Figure 11:
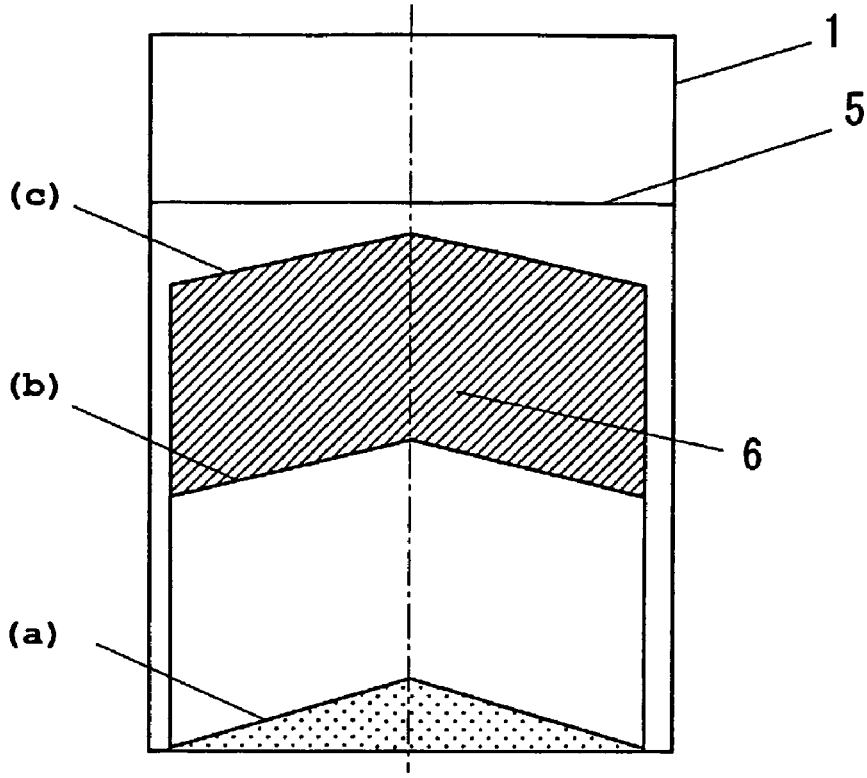
FIG. 11 is a conceptual illustration of growth of the titanium sponge large mass in the first invention.

Moreover, in the second invention, together with the regulation of the level 20 of the reactant-product bath liquid interface at a predetermined value, the level 19 of the reduction bath liquid surface is set at a predetermined range using an apparatus for changing the bath surface level. As an example of the apparatus for changing the bath surface level 19 of the reduction bath liquid, in FIG. 1A, a block is placed at the end of the cylinder placed in the vessel, the quantity of the reduction bath liquid to be exclude by the block is adjusted by changing the immersing depth of the block into the reduction bath, and thereby, the level of the reduction bath liquid surface can be set at the predetermined level. Moreover, the levels of the reduction bath liquid surface and the reactant-product bath liquid interface can be independently controlled by placing a second block capable of moving upward and downward in the reaction vessel, immersing it into the product bath liquid beyond the reactant-product bath liquid interface, and changing the immersing depth and the immersing depth of the first block present in the reactant bath liquid. Thus produced titanium sponge large mass has a shape which is conical only at the top of the large mass and can be roughly regarded as a cylinder as shown in FIG. 1B, and hence a larger quantity of the sponge can be produced in the reduction bath liquid. The following will describe the mechanism that the titanium sponge large mass becomes a cylinder in the first invention. In the first invention, since the elevation rate of the reactant-product bath liquid interface is small, the titanium sponge large mass can grow always sufficiently in the radial direction to a large extent. As a result, the titanium sponge large mass grow cylindrically in the order of (a)→(b)→(c) shown in FIG. 11.

The setting method for growing the titanium sponge large mass into a thick cylinder is described in the above example. In the first invention, since the level shift 15 of the reactant-product bath liquid interface can be freely set, it is possible to form the titanium sponge mass in other shapes. For example, a thin cylindrical titanium sponge large mass can be formed by setting the elevation rate of the reactant-product bath liquid interface at a large rate at the early stage of the reduction reaction and at a small rate at the later stage of the reduction reaction. The formation of this shape cannot increase the production per one batch, but time for treatment in the separation step after the reduction can be shortened in the case that production of only a small quantity of the titanium sponge is intended. This is because the rate determining operation in the separation step is evaporation of the remaining reduction bath liquid at the largest diameter part of the titanium sponge large mass and the remaining reduction bath liquid in a thin cylindrical titanium sponge large mass can be evaporated within a shorter time as compared with the case of a conical sponge in the conventional art since the maximum sponge diameter of the cylindrical mass is smaller than that of the conical mass even when the volumes are the same.

Incidentally, as a method for detecting the level of the reactant-product bath liquid interface in the first invention, there may be mentioned a method wherein a number of ohmmeters are placed in the depth direction in the bath and the region where electric resistance rapidly changes between adjacent ohmmeters is regarded as the level of the reactant-product bath liquid interface utilizing the fact that electric resistance is largely different between the reactant bath liquid and the product bath liquid.

The "level of a liquid surface" herein includes both of the level of the reduction bath liquid surface and the level of the reactant-product bath liquid interface.

"To set" the level of the liquid surface herein means to adjust operation quantity of the apparatus for changing the level of a liquid surface so as to achieve the predetermined aimed value of the level of a liquid surface using input data such as a previously determined level of the liquid surface or reduction reaction conditions, and indicates any of a feedforward control alone, a feedback control alone, or a control wherein both of a feedforward control and a feedback control are carried out. These "controls" not necessarily require a computing apparatus and include, for example, an operation standardized so that an operator may take steps for changing the level of a liquid surface at each time when an accumulated supply of titanium tetrachloride reaches a specific quantity during the reduction reaction.

Figure 2:
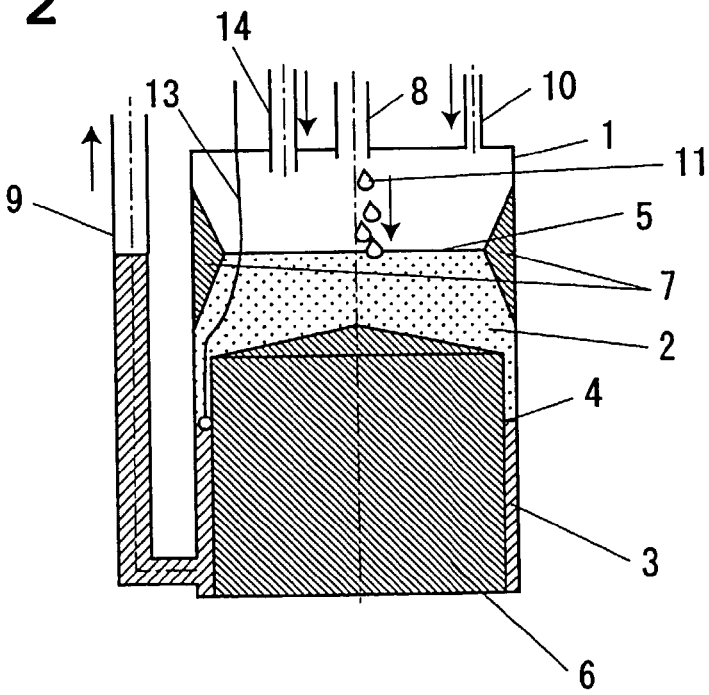
FIG. 2 is a conceptual illustration of the third invention.

The following will explain the third invention with reference to the conceptual illustration of FIG. 2. The invention relates to a method for changing the level 19 of the reduction bath liquid surface in the process of the first invention, wherein an apparatus for supplying magnesium from the top of the reaction vessel through a magnesium-supply pipe 14 is used.

Essential points of the difference between the third invention and the conventional art are described. In the conventional art, there also exist technologies wherein fused magnesium is supplied into the reaction vessel during the reduction reaction as described in JP-A-52-49921. However, in all these technologies, the purpose is to obtain highly pure titanium sponge or to avoid decrease of the reaction rate by reducing the decrease of magnesium concentration in the reactant bath liquid at a later stage of the reduction reaction, and the supply of magnesium is carried out only once at a later stage of the reduction reaction. Therefore, by supplying magnesium, the level of the reduction bath liquid surface and the level of the reactant-product bath liquid interface are not set, the shape of the titanium sponge mass is always fixed to a conical shape, and the production per one batch is not increased. On the other hand, in the third invention, supply of magnesium is permitted two or more times from an early stage of the reduction reaction, and the titanium sponge large mass can be formed in a cylindrical shape capable of increasing the production per one batch by setting the level of the reduction bath liquid surface and the level of the reactant-product bath liquid interface during the reduction reaction so as to maintain the levels within predetermined ranges.

In the third invention, magnesium may be supplied in a liquid or particulate or block form. When magnesium is supplied in a liquid form, a supply of magnesium may be set by placing a fused magnesium tank and a valve for regulating the efflux which are not shown in the figure in the upstream of the magnesium-supply pipe 14, and controlling valve travel or valve-opened time. Moreover, when magnesium is supplied in a particulate form, a supply of magnesium may be set by placing a magnesium particle hopper and a valve for regulating the efflux which are not shown in the figure in the upstream of the magnesium-supply pipe 14, and controlling valve travel or valve-opened time. Furthermore, when magnesium is supplied in a block form, a supply of magnesium may be set by placing a block reservoir which is not shown in the figure in the upstream of the magnesium-supply pipe 14, dropping the magnesium blocks in the reservoir one by one into the reduction bath liquid by a pusher or the like through the magnesium-supply pipe 14, and controlling number of the blocks to be dropped and dropping frequency. In addition, when magnesium is supplied in a liquid form intermittently, it is possible to use the other pipe, e.g., the product bath liquid-discharge pipe 9 also as a magnesium-supply pipe to simplify the equipment. In this case, a branch is provided for the product bath liquid-discharge pipe 9 and a pressurizable fused magnesium tank and a valve are placed at the end of the branch which are not shown in the figure. At the time when magnesium is supplied to the reactant bath liquid, a pressurized magnesium melt liquid is introduced into the reaction vessel through the product bath liquid-discharge pipe 9 and then the mixture is allowed to stand for a certain period of time. After a certain period of time, the reduction bath liquid separates again into the reactant bath liquid and the product bath liquid and supplied magnesium is absorbed into the reactant bath liquid. Magnesium may be supplied continuously or intermittently during the reduction reaction. When magnesium is supplied intermittently, a supply of magnesium is set at a small quantity so that the fluctuation of the bath surface level caused by one-time supply of magnesium is, for example, 500 mm or less, in order to avoid the exposure of the titanium sponge large mass at the time when the bath surface of the reduction bath liquid is lowered. When magnesium is supplied intermittently, frequency of the supply of magnesium may be suitably set to be one or more times during the reduction reaction so as to maintain a small fluctuation of the level of the reduction bath liquid surface. Moreover, the excellent features of the third invention as the method for changing the level of the reduction bath liquid surface are a little contamination of the reduction bath liquid and no damage of the instruments such as a block by immersing them into the bath liquid since foreign articles such as the block are not immersed in the bath liquid.

The following will describe the reduction reaction condition of the elevation rate θ of the reactant-product bath liquid interface. First, in FIG. 5, from the viewpoint of forming the large mass in a cylindrical form, the rate should be set at a smaller condition than the point (a) in FIG. 5 so that the titanium sponge mass grows as large as possible. However, even when θ is set at a value smaller than θ at the point (a), the average diameter of the titanium sponge large mass do not increase from the average diameter at the point (a). On the other hand, as θ becomes small, a larger amount of magnesium should be supplied during the reduction reaction, so that workability and economical efficiency become worse. Therefore, an optimum value θ corresponding to the point (a) exists in the third invention. As a result of precise investigations, the inventors have determined the optimum value of θ. Namely, the discharge rate of the product bath liquid at the point (a) is 0.9 t (product)/t (titanium tetrachloride). This optimum value is not influenced by the cross-sectional area of the vessel. Because of the presence of the optimum value of θ, the process of the invention is largely different from the conventional process wherein magnesium is additionally supplied during the reduction reaction with no particular consideration of the supply rate.

The following will explain the fourth invention which is dependent on the process for producing metallic titanium described in any of the first invention, the second invention, and the third invention. The fourth invention relates to a method for estimating the level of the reactant-product bath liquid interface during the reduction reaction with no necessity of using a measuring instrument of the reactant-product bath liquid interface. The following will show one example. First, a quantity of the reactant bath liquid, a quantity of the product bath liquid, and a quantity of metallic titanium present in the reaction vessel can be calculated according to the following equations using an initial quantity of the reduction bath liquid, an accumulated supply of titanium tetrachloride at that point of time, an accumulated discharge of the product, and the chemical equation of the formula (1).

$$[\text{Volume of reactant bath liquid}] = [\text{Initial volume of reduction bath liquid}] - 0.25/[\text{Density of reactant bath liquid}] \times [\text{Weight of accumulated supply of titanium tetrachloride}] \quad (3)$$

$$[\text{Volume of product bath liquid}] = [\text{Weight of accumulated supply of titanium tetrachloride}]/[\text{Density of product bath liquid}] - [\text{Accumulated volume of discharge liquid}] \quad (4)$$

$$[\text{Volume of metallic titanium}] = 0.25 \times [\text{Weight of accumulated supply of titanium tetrachloride}]/[\text{Density of metallic titanium}] \quad (5)$$

Therein, the density of each substance is given as a physical value from known Tables beforehand.

Then, a shape pattern of the titanium sponge large mass is presumed. The titanium sponge large mass is herein regarded as a cylinder, which is assumed to grow upward. Next, the height of the titanium sponge large mass is presumed. Herein, the following is presumed.

$$[\text{Height of titanium sponge large mass}] = H_{max} \times [\text{Fixed value C}]$$

Therein, $H_{max}$ is a "maximum value of the level of the reactant-product bath liquid interface" and is defined as the highest level of the reactant-product bath liquid interface recorded until the point of time when the height of the titanium sponge large mass is calculated. Moreover, the combination of the shape pattern of the titanium sponge large mass and the height of the titanium sponge large mass is defined as "shape of the titanium sponge large mass". Then, a ratio A of fused magnesium to the volume of metallic titanium in the titanium sponge large mass and a ratio B of fused magnesium chloride to the volume of metallic titanium in the titanium sponge large mass are presumed. Therein, the ratios are set as A=B=0 empirically. A and B herein correspond to "quantity of fused magnesium in the titanium sponge mass" and "quantity of fused magnesium chloride contained in the titanium sponge mass", respectively. The shape of the titanium sponge large mass, A, and B may be suitably set by observing the sponge in actual operation.

Next, the level of the reactant-product bath liquid interface is determined. The simplest method is to presume that the ratio between metallic titanium and fused magnesium and fused magnesium chloride in the titanium sponge mass is always constant irrespective of the position. At that time, when the titanium sponge large mass concentrical with the vessel is present in a cylindrical reaction vessel on the bottom of the vessel, the level of the reactant-product bath liquid interface is expressed by the following equations. First, in the case that the height of the titanium sponge large mass is not more than the level of the reactant-product bath liquid interface, the following is applicable.

$$[\text{Level of reactant-product bath liquid interface}] = \{[\text{Volume of product bath liquid}] + (1 + A) \times [\text{Volume of metallic titanium}]\} / [\text{Cross-sectional area of reaction vessel}] \quad (6)$$

To the contrary, in the case that the height of the titanium sponge large mass is higher than the level of the reactant-product bath liquid interface, the following is applicable.

$$[\text{Level of reactant-product bath liquid interface}] = ([\text{Volume of product bath liquid}] - B \times [\text{Volume of metallic titanium}]\} / [\text{Cross-sectional area of reaction vessel}] - (1 + A + B) \times [\text{Volume of metallic titanium}] / (C \times H_{max})\} \quad (7)$$

Therein, in discriminating the relationship in size between the height of the large mass and [Level of reactant-product bath liquid interface], since the relationship between [Level of reactant-product bath liquid interface] obtained by the calculation according to each of Equations 6 and 7 and the height of the titanium sponge large mass is only consistent with either premise of Equation 6 or 7, it is appropriate to adopt the premise of the equation which is consistent. Moreover, there may be the case that the level of the reactant-product bath liquid interface cannot be formulated positively, unlike Equations 6 and 7, by presuming the height of the large mass and the shape of the vessel more complicatedly, but in that case, the level of the reactant-product bath liquid interface may be determined negatively by computation.

In the above method for estimating the level of the reactant-product bath liquid interface, the inventors have found that estimation error occurs at the rate of several tens % or more in the case that any one of the initial quantity of the reduction bath liquid, the accumulated supply of titanium tetrachloride, the accumulated discharge of the product bath liquid, estimated shape of the sponge mass, the estimated weight of fused magnesium contained in the titanium sponge mass, and the estimated weight of fused magnesium chloride contained in the titanium sponge mass is not available. That is, these elements compose a minimum constitution for estimating the level of the reactant-product bath liquid interface. Therefore, it is possible to add additional element(s) to the minimum constitution optionally, and there may be a case that estimation accuracy can be slightly improved by the adding element(s). As the elements to be added, there may be mentioned shape of the upper wall sponge mass, weight of magnesium in the titanium sponge mass in the upper wall, weight of magnesium chloride in the titanium sponge mass in the upper wall, concentration of magnesium chloride in the reactant bath liquid, quantity of floating metallic titanium in the reactant bath liquid, concentration of magnesium in the product bath liquid, quantity of floating metallic titanium in the product bath liquid, interfacial force between the reduction bath liquid-constituting substances, interfacial force between the reduction bath liquid-constituting substances and the substance of the inner wall of the vessel, evaporation quantity of the reduction bath liquid, accumulated quantity of unreacted titanium tetrachloride, and the like. These elements may be not essential elements because a large estimation error does not occur even when these elements are not used for the estimation of the level of the reactant-product bath liquid interface. The characteristic feature of the fourth invention is that a highly accurate estimation is enabled by including the aforementioned essential elements in the elements used for estimating the level of the reactant-product bath liquid interface. In addition, the advantage of the fourth invention is that the equipment can be simplified because of no necessity of a measuring instrument of the reactant-product bath liquid interface.

Additionally, examples of the measuring method of each measured value will be described. The initial quantity of the reduction bath liquid may be determined by measuring the weight of the reaction vessel, in which initial reduction bath liquid is stored, before the start of the reduction reaction. The accumulated supply of titanium tetrachloride may be determined by placing a commercially-available flowmeter in the piping of titanium tetrachloride supply and measuring and recording the flow rate continuously. The accumulated discharge of the product bath liquid may be determined by receiving the discharged product bath liquid into a vessel and measuring the weight thereof including the vessel.

The present invention will be illustrated in greater detail with reference to the following Examples, but the invention should not be construed as being limited thereto.

Figure 3:
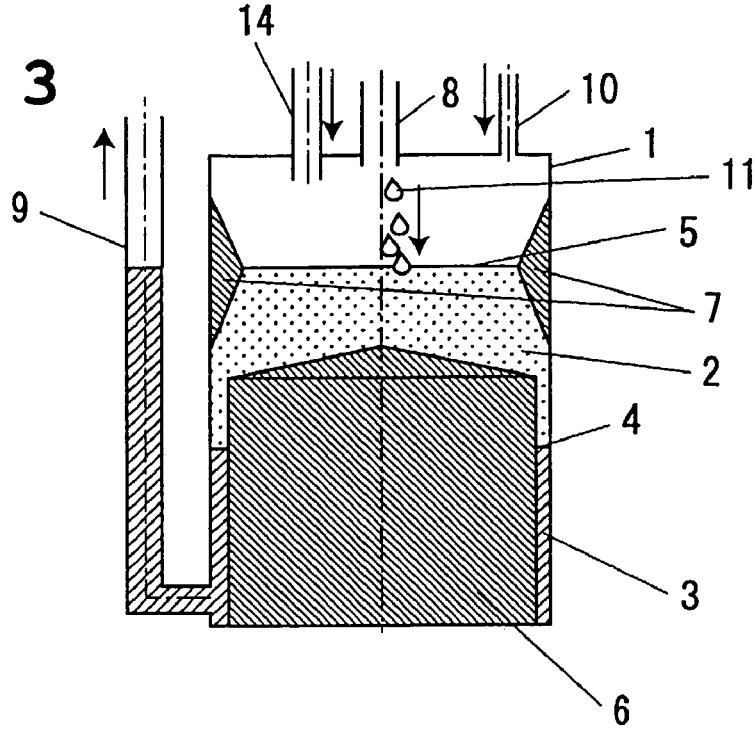
FIG. 3 is a conceptual illustration of the forth invention.
Figure 4A:
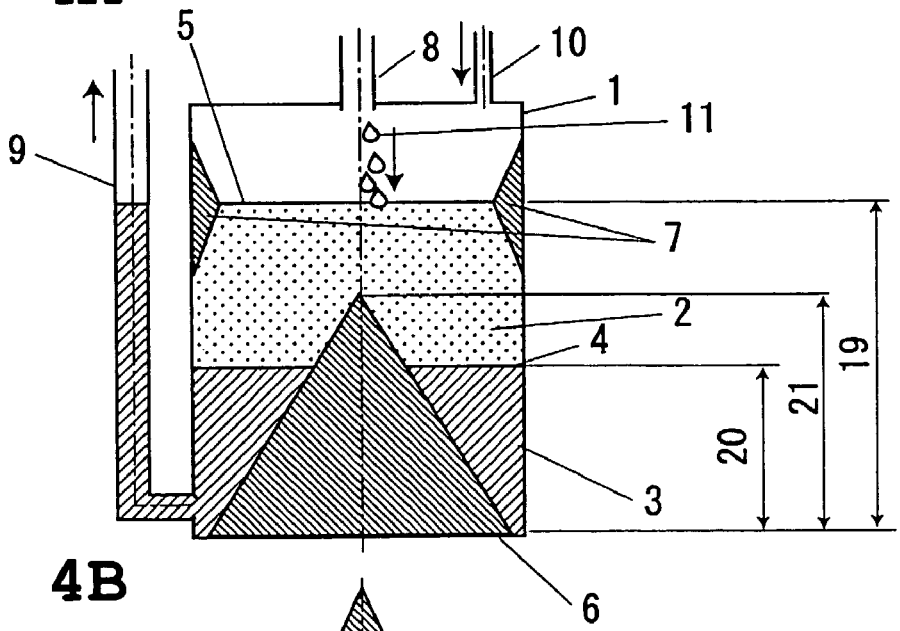
FIGS. 4A and 4B each is a conceptual illustration of the conventional art.
Figure 4B:
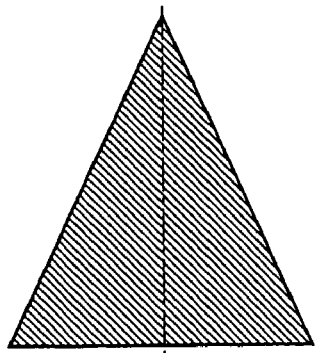

Examples of the first invention to the fourth invention will be explained with reference to FIGS. 4A and 4B. The constitution of the apparatus shown in FIG. 4A is the same as in FIG. 3 except the method for recognizing the level of the reactant-product bath liquid interface. The level of the reactant-product bath liquid interface was estimated using the same method as the example described in the explanation of the fourth invention in DETAILED DESCRIPTION OF THE INVENTION. The reaction vessel was a cylindrical vessel having an inner diameter of 1.8 m and a height of 5 m and titanium tetrachloride was supplied at a flow rate of 300 kg/m$^2$Hr. During the reduction reaction, the product bath liquid was discharged intermittently 20 times in total from the reaction vessel. At that time, the quantity of the product bath liquid to be discharged was set at 0.9 t/t of titanium tetrachloride supply on average over the whole reduction reaction. Moreover, during the reduction reaction, fused magnesium was supplied intermittently 3 times in total through the magnesium-supply pipe 14. At supplying magnesium, the quantity of magnesium to be supplied into the reaction vessel was set at 0.94 t per 1 t of the discharge of the product bath liquid, which exceeds 0.82 t per 1 t of titanium tetrachloride supply, on average over the whole reduction reaction to maintain the fluctuation of the bath surface during the reduction reaction in a certain range. As a result, even when 40 t of titanium tetrachloride was supplied, the large mass was not exposed above the bath surface. Finally, 10 t of cylindrical titanium sponge was obtained as a product, and the maximum production of the sponge per one batch in this apparatus in the conventional art could be increased by 20%.

While the invention has been described in detail and with reference to specific embodiments thereof, it will be apparent to one skilled in the art that various changes and modifications can be made therein without departing from the spirit and scope thereof.

What is claimed is:

1. A process for producing titanium sponge which comprises carrying out a reducing reaction by supplying titanium tetrachloride to a reaction vessel which stores a reduction bath liquid comprising an upper layer of a reactant bath liquid layer containing fused magnesium as a main component and a lower layer of a product bath liquid layer containing fused magnesium chloride as a main component, which process includes optimizing the level of the interface between the reactant bath liquid layer and the product bath liquid layer and the level of the reduction bath liquid surface for a desired shape of titanium sponge product, based on measurement of an accumulated supply of titanium tetrachloride.

2. The process for producing titanium sponge according to claim 1, wherein the level of the interface between the reactant bath liquid layer and the product bath liquid layer and the level of the reduction bath liquid surface are changed by immersing a block-like article which is placed at an upper part in the reaction vessel and is capable of moving upward and downward.

3. The process for producing titanium sponge according to claim 1, wherein the level of the reduction bath liquid surface is optimized by supplying solid or liquid magnesium from the outside of the reaction vessel during the reduction reaction.

4. The process for producing titanium sponge according to claim 1, wherein optimizing the level of the interface between the reactant bath liquid layer and the product bath liquid layer is carried out by performing calculations from the shape of formed titanium sponge mass, quantities of fused magnesium and fused magnesium chloride contained in the titanium sponge mass, a quantity of initial reduction bath liquid, an accumulated supply of titanium tetrachloride, and an accumulated discharge of the product.

5. The process for producing titanium sponge according to claim 4, wherein calculations from the shape of formed titanium sponge mass, quantities of fused magnesium and fused magnesium chloride contained in the titanium sponge mass, are based on estimates thereof.

6. A process for producing titanium sponge which comprises carrying out a reducing reaction by supplying titanium tetrachloride to a reaction vessel which stores a reduction bath liquid comprising an upper layer of a reactant bath liquid layer containing fused magnesium as a main component and a lower layer of a product bath liquid layer containing fused magnesium chloride as a main component, which process includes forming a titanium sponge large mass part having a desired shape by optimizing the level of the interface between the reactant bath liquid layer and the product bath liquid layer and the level of the reduction bath liquid surface, for said shape.

7. The process for producing titanium sponge according to claim 6, wherein the desired shape is generally cylindrical.

8. A process for producing titanium sponge which comprises carrying out a reducing reaction by supplying titanium tetrachloride to a reaction vessel which stores a reduction bath liquid comprising an upper layer of a reactant bath liquid layer containing fused magnesium as a main component and a lower layer of a product bath liquid layer containing fused magnesium chloride as a main component, wherein the level of the interface between the reactant bath liquid layer and the product bath liquid layer and the level of the reduction bath liquid surface are controlled in response to an accumulated supply of titanium tetrachloride, wherein the level of the reduction bath liquid surface is controlled by supplying solid or liquid magnesium from the outside of the reaction vessel during the reduction reaction.

* * * * *